US005708414A

United States Patent [19]

Peltier et al.

[11] Patent Number: 5,708,414

[45] Date of Patent: Jan. 13, 1998

[54] SENSITIVITY FAULT INDICATION TECHNIQUE IMPLEMENTED IN SMOKE DETECTOR SYSTEM WITH SELF-DIAGNOSTIC CAPABILITIES

[75] Inventors: Mark A. Peltier, Sherwood, Oreg.; Douglas H. Marman, Ridgefield, Wash.; Brent T. Krieger, Tualatin, Oreg.

[73] Assignee: Sentrol, Inc., Tualatin, Oreg.

[21] Appl. No.: 695,748

[22] Filed: Aug. 12, 1996

Related U.S. Application Data

[63] Continuation-in-part of Ser. No. 110,131, Aug. 19, 1993, Pat. No. 5,546,074.

[51] Int. Cl.[6] ..... G08B 29/00

[52] U.S. Cl. ..... 340/506; 340/511; 340/512; 340/516; 340/630; 250/574; 356/438

[58] Field of Search ..... 340/628, 630, 340/506, 507, 511, 512, 514, 516, 517; 250/573, 574; 356/438; 116/214

[56] References Cited

U.S. PATENT DOCUMENTS

| | | | |
|---|---|---|---|
| 2,473,314 | 6/1949 | Toulon | 177/311 |
| 3,143,161 | 8/1964 | Graves et al. | 158/28 |
| 3,530,450 | 9/1970 | Walthard et al. | 340/214 |
| 3,543,260 | 11/1970 | Engh | 340/228 |
| 3,657,713 | 4/1972 | Sasaki et al. | 340/214 |
| 3,678,510 | 7/1972 | Walthard et al. | 340/410 |
| 3,683,372 | 8/1972 | Horn | 340/410 |
| 3,882,477 | 5/1975 | Mueller | 340/237 S |
| 3,928,849 | 12/1975 | Schwarz | 340/410 |
| 4,097,850 | 6/1978 | Conforti | 340/214 |
| 4,099,178 | 7/1978 | Ranney et al. | 340/515 |
| 4,168,438 | 9/1979 | Morisue | 250/574 |
| 4,199,755 | 4/1980 | Tanaka | 340/630 |
| 4,225,791 | 9/1980 | Kompelien | 250/574 |
| 4,232,307 | 11/1980 | Marsocci | 340/515 |

(List continued on next page.)

FOREIGN PATENT DOCUMENTS

| | | | |
|---|---|---|---|
| 590527 | 8/1977 | Switzerland | G08B 17/107 |
| 2203238 | 10/1988 | United Kingdom | G08B 17/107 |

OTHER PUBLICATIONS

Motorola Semiconductor Technical Data for MC 145010, *Motorola CMOS Application–Specific Digital–Analog Integrated Circuits*, 1991, pp. 7–21–7–30.

Motorola Semiconductor Technical Data for MC 145011, *Motorola CMOS Application–Specific Digital–Analog Integrated Circuits*, 1991, pp. 7–31–7–40.

The Sensicheck Principle: A New Concept in Fire Detection, Aritech, 1989.

Technical Bulletin ESL Series 600 Fire Detectors, 1989 (25 pages).

*Primary Examiner*—Jeffery Hofsass
*Assistant Examiner*—Daniel J. Wu
*Attorney, Agent, or Firm*—Stoel Rives LLP

[57] ABSTRACT

Self-contained smoke detector systems each have internal self-diagnostic capabilities and function as components of an automatic fire alarm communication system implemented with a conventional two-wire alarm initiating circuit. Each system includes a microprocessor-based self-diagnostic circuit that periodically checks sensitivity of radiation sensor electronics to smoke obscuration level. By setting tolerance limits on the amount of change in voltage measured in clean air, the system can provide an indication of when it has become either under-sensitive or over-sensitive to the ambient smoke obscuration level. An algorithm implemented in software stored in system memory determines whether and provides a sensitivity fault condition signal indicating that for a time (such as 27 hours) the clean air voltage has strayed outside established sensitivity tolerance limits. The sensitivity fault condition signal includes multiple time displaced pulses, each of which having a duration and a magnitude that cooperate to diminish the probability of approximately concurrent sensitivity fault condition signals produced by multiple smoke detector systems causing the alarm initiating circuit to generate a false alarm signal.

9 Claims, 12 Drawing Sheets

U.S. PATENT DOCUMENTS

| | | | |
|---|---|---|---|
| 4,246,572 | 1/1981 | Larsen | 340/501 |
| 4,302,753 | 11/1981 | Conforti | 340/628 |
| 4,306,230 | 12/1981 | Forss et al. | 340/630 |
| 4,321,466 | 3/1982 | Mallory et al. | 250/574 |
| 4,388,615 | 6/1983 | Ford et al. | 340/516 |
| 4,394,655 | 7/1983 | Wynne et al. | 340/825.36 |
| 4,459,583 | 7/1984 | van der Walt et al. | 340/589 |
| 4,469,953 | 9/1984 | Fujisawa et al. | 250/574 |
| 4,470,047 | 9/1984 | Vogt et al. | 340/825.36 |
| 4,524,351 | 6/1985 | Kimura et al. | 340/629 |
| 4,595,914 | 6/1986 | Siegel | 340/515 |
| 4,647,786 | 3/1987 | Guttinger et al. | 250/574 |
| 4,672,217 | 6/1987 | Dobrzanski | 250/574 |
| 4,692,750 | 9/1987 | Murakami et al. | 340/630 |
| 4,758,733 | 7/1988 | Mochizuki | 250/574 |
| 4,893,005 | 1/1990 | Stiebel | 250/221 |
| 5,021,677 | 6/1991 | Igarashi et al. | 340/630 |
| 5,083,107 | 1/1992 | Takahashi et al. | 340/506 |
| 5,117,219 | 5/1992 | Tice et al. | 340/506 |
| 5,400,014 | 3/1995 | Behlke et al. | 340/630 |
| 5,440,293 | 8/1995 | Tice et al. | 340/506 |
| 5,543,777 | 8/1996 | Vane et al. | 340/514 |
| 5,546,074 | 8/1996 | Bernal et al. | 340/630 |
| 5,552,765 | 9/1996 | Vane et al. | 340/515 |

SENSITIVITY FAULT INDICATION TECHNIQUE IMPLEMENTED IN SMOKE DETECTOR SYSTEM WITH SELF-DIAGNOSTIC CAPABILITIES

RELATED APPLICATION

This is a continuation-in-part of application Ser. No. 08/110,131, filed Aug. 19, 1993 now U.S. Pat. No. 5,546,074.

TECHNICAL FIELD

The present invention relates to smoke detector systems and, in particular, to a sensitivity fault indication technique implemented in a smoke detector system that has internal self-diagnostic capabilities.

BACKGROUND OF THE INVENTION

A photoelectric smoke detector system measures the ambient smoke conditions of a confined space and activates an alarm in response to the presence of unacceptably high amounts of smoke. This is accomplished by installing in a housing covered by a smoke intake canopy a light-emitting device ("emitter") and a light sensor ("sensor") positioned in proximity to measure the amount of light transmitted between them.

A first type of smoke detector system positions the emitter and sensor so that their lines of sight are collinear. The presence of increasing amounts of smoke increases the attenuation of light passing between the emitter and the sensor. Whenever the amount of light striking the sensor drops below a minimum threshold, the system activates an alarm.

A second type of smoke detector system positions the emitter and sensor so that their lines of sight are offset at a sufficiently large angle that very little light propagating from the emitter directly strikes the sensor. The presence of increasing amounts of smoke increases the mount of light scattered toward and striking the sensor. Whenever the amount of light striking the sensor increases above a maximum threshold, the system activates an alarm.

Because they cooperate to measure the presence of light and determine whether it exceeds a threshold amount, the emitter and sensor need initial calibration and periodic testing to ensure their optical response characteristics are within the nominal limits specified. Currently available smoke detector systems suffer from the disadvantage of requiring periodic inspection of system hardware and manual adjustment of electrical components to carry out a calibration sequence.

The canopy covering the emitter and sensor is an important hardware component that has two competing functions to carry out. The canopy must act as an optical block for outside light but permit adequate smoke particle intake and flow into the interior of the canopy for interaction with the emitter and sensor. The canopy must also be constructed to prevent the entry of insects and dust, both of which can affect the optical response of the system and its ability to respond to a valid alarm condition. The interior of the canopy should be designed so that secondary reflections of light occurring within the canopy are either directed away from the sensor and out of the canopy or absorbed before they can reach the sensor.

Self-diagnostic smoke detector systems functioning as components of an automatic fire alarm communication system implemented with a conventional two-wire alarm initiating circuit can create an anomalous alarm condition. This anomaly can occur when several self-diagnostic smoke detector systems concurrently develop sensitivity fault indication signals representative of out-of-calibration conditions that would require canopy replacement or cleaning to restore nominal operation.

What is needed, therefore, is a sensitivity fault indication technique that does not create an anomalous alarm condition.

SUMMARY OF THE INVENTION

An object of the invention is, therefore, to provide a smoke detector system that is capable of performing self-diagnostic functions to determine whether it is within its calibration limits and thereby to eliminate a need for periodic manual calibration testing.

Another object of the invention is to implement in such a system a sensitivity fault indication technique that produces without creating an anomalous alarm condition an out-of-calibration signal on an automatic fire alarm communication system implemented with a conventional two-wire alarm initiating circuit.

A further object of the invention is to provide such a system that accepts a replacement smoke intake canopy without requiring recalibration.

The present invention is a self-contained smoke detector system that has internal self-diagnostic capabilities and accepts a replacement smoke intake canopy without a need for recalibration. A preferred embodiment includes a light-emitting diode ("LED") as the emitter and a photodiode sensor. The LED and photodiode are positioned and shielded so that the absence of smoke results in the photodiode's receiving virtually no light emitted by the LED and the presence of smoke results in the scattering of light emitted by the LED toward the photodiode.

The system includes a microprocessor-based self-diagnostic circuit that periodically checks the sensitivity of the optical sensor electronics to smoke obscuration level. There is a direct correlation between a change in the clean air voltage output of the photodiode and its sensitivity to the smoke obscuration level. Thus, by setting tolerance limits on the amount of change in voltage measured in clean air, the system can provide an indication of when it has become either under-sensitive or over-sensitive to the ambient smoke obscuration level.

The system samples the amount of smoke present by periodically energizing the LED and then determining the smoke obscuration level. An algorithm implemented in software stored in system memory determines whether for a time (such as 27 hours) the clean air voltage is outside established sensitivity tolerance limits. Upon determination of an under- or over-sensitivity condition, the system provides an indication that a problem exists with the optical sensor electronics.

The LED and photodiode reside in a compact housing having a replaceable smoke intake canopy of preferably cylindrical shape with a porous side surface. The canopy is specially designed with multiple pegs having multi-faceted surfaces. The pegs are angularly spaced about the periphery in the interior of the canopy to function as an optical block for external light infiltrating through the porous side surface of the canopy and to minimize spurious light reflections from the interior of the housing toward the photodiode. This permits the substitution of a replacement canopy of similar design without the need to recalibrate the optical sensor electronics previously calibrated during installation at the factory. The pegs are positioned and designed also to form a labyrinth of passageways that permit smoke to flow freely through the interior of the housing.

In a preferred embodiment, the smoke detector system is one of many such systems functionally connected to an automatic fire alarm communication system implemented with a conventional two-wire alarm initiating circuit. Each smoke detector system includes a two-wire detector that draws electrical current in the form of a predetermined sensitivity fault pulse sequence from the communication system control panel when the smoke detector system drifts out of its nominal sensitivity range. It has been empirically determined that the anomalous alarm indication remits from a total average current draw from the panel during approximately concurrent sensitivity fault indications by multiple detectors that exceeds an alarm threshold set at the control panel. The sensitivity fault pulse sequence implemented in each detector substantially reduces the probability of an anomalous alarm condition stemming from multiple sensitivity fault indications occurring within a predetermined time window.

Additional objects and advantages of the present invention will be apparent from the following detailed description of a preferred embodiment thereof, which proceeds with reference to the accompanying drawings.

DETAILED DESCRIPTION OF A PREFERRED EMBODIMENT

Figure 1:
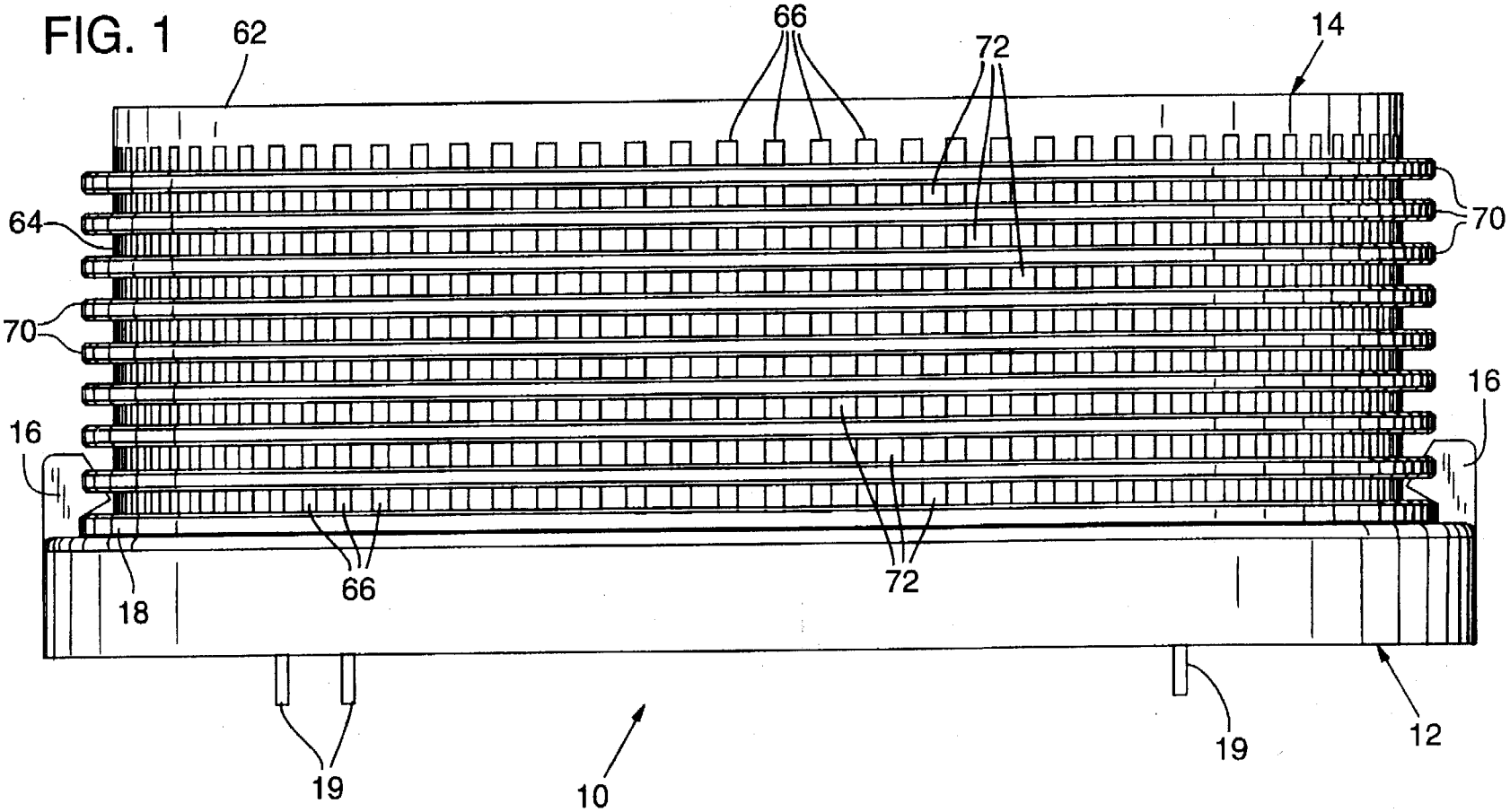
FIG. 1 is a side elevation view of the assembled housing for the smoke detector system of the present invention.

FIGS. 1–5 show a preferred embodiment of a smoke detector system housing 10 that includes a circular base 12 covered by a removable smoke intake canopy 14 of cylindrical shape. Base 12 and canopy 14 are formed of molded plastic whose color is black so as to absorb light incident to it. A pair of diametrically opposed clasps 16 extend from base 12 and fit over a snap ting 18 encircling the rim of canopy 14 to hold it and base 12 together to form a low profile, unitary housing 10. Housing 10 has pins 19 that fit into holes in the surface of a circuit board (not shown) that holds the electronic components of the smoke detector system.

Figure 2:
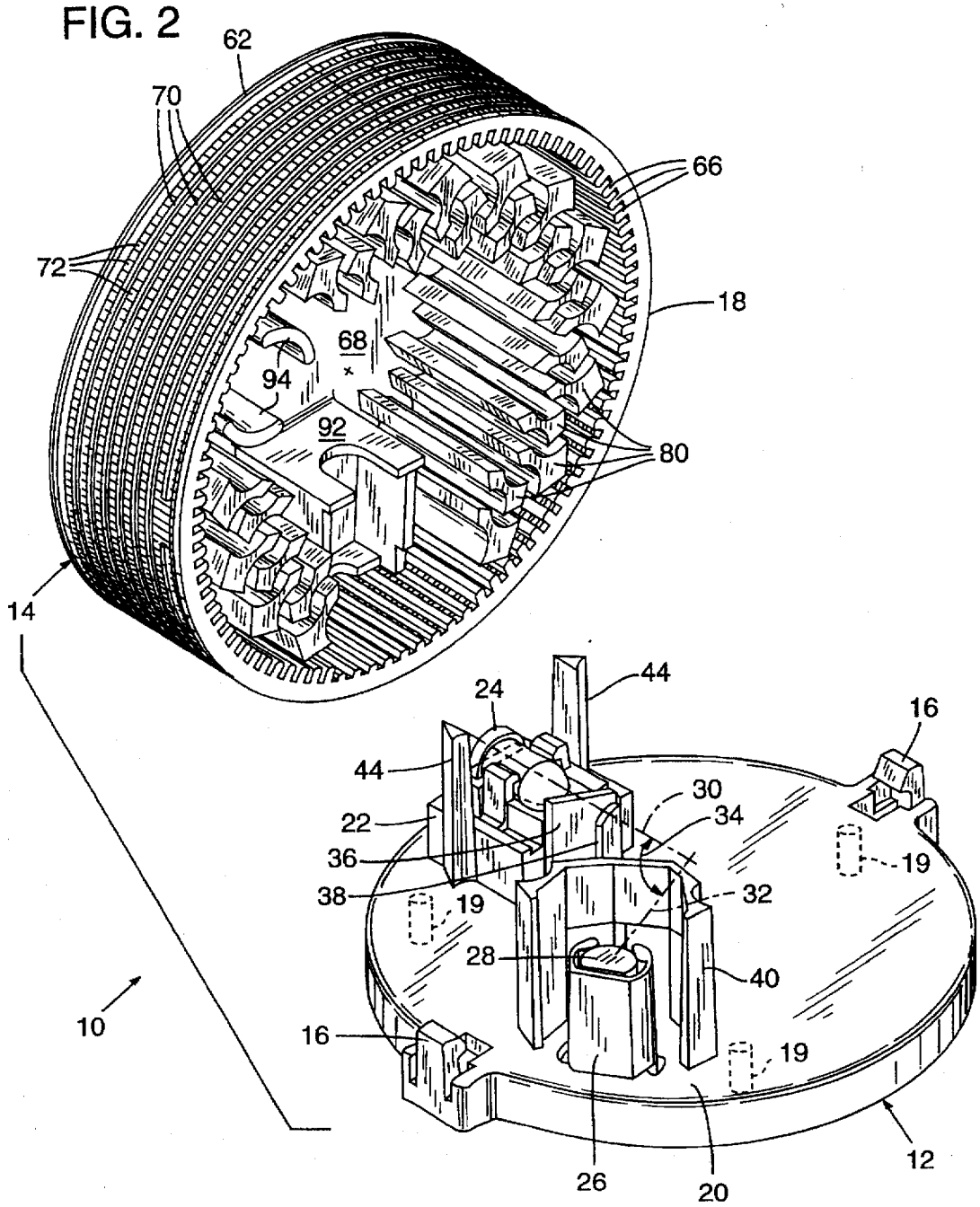
FIG. 2 is an isometric view of the housing of FIG. 1 with its replaceable smoke intake canopy and base disassembled to show the placement of the optical components in the base.
Figure 3:
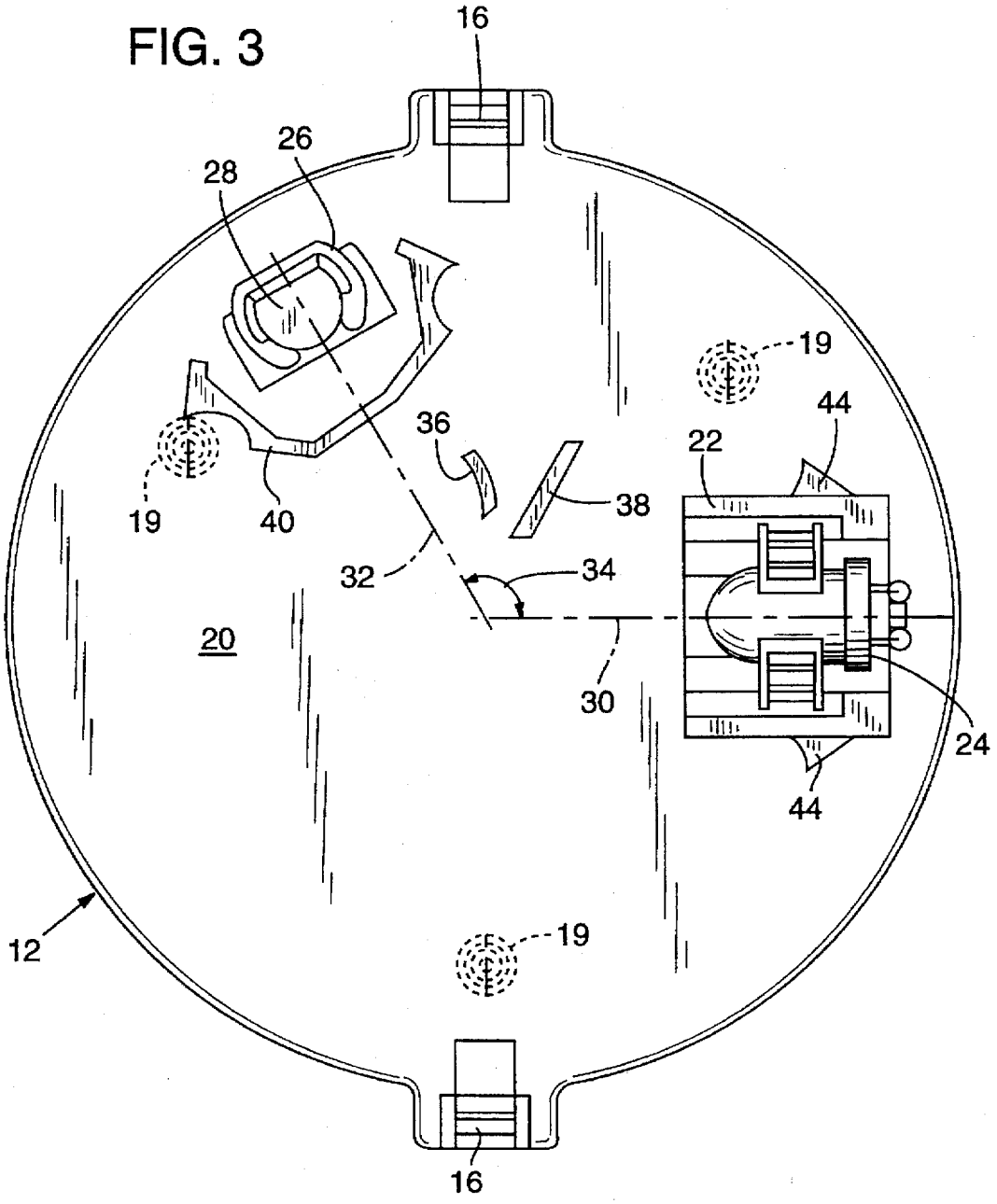
FIG. 3 is plan view of the base shown in FIG. 2.

With particular reference to FIGS. 2 and 3, base 12 has an inner surface 20 that supports an emitter holder 22 for a light-emitting diode (LED) 24 and a sensor holder 26 for a photodiode 28. LED 24 and photodiode 28 are angularly positioned on inner surface 20 near the periphery of base 12 so that the lines of sight 30 and 32 of the respective LED 24 and photodiode 28 intersect to form an obtuse angle 34 whose vertex is near the center of base 12. Angle 34 is preferably about 120°. Light-blocking fins 36 and 38 positioned between LED 24 and photodiode 28 and a light shield 40 covering both sides of photodiode 28 ensure that light emitted by LED 24 in a clean air environment does not reach photodiode 28. Together with light shield 40, a pair of posts 44 extending upwardly from either side of emitter holder 22 guide the positioning of canopy 14 over base 12 during assembly of housing 10.

Figure 4A:
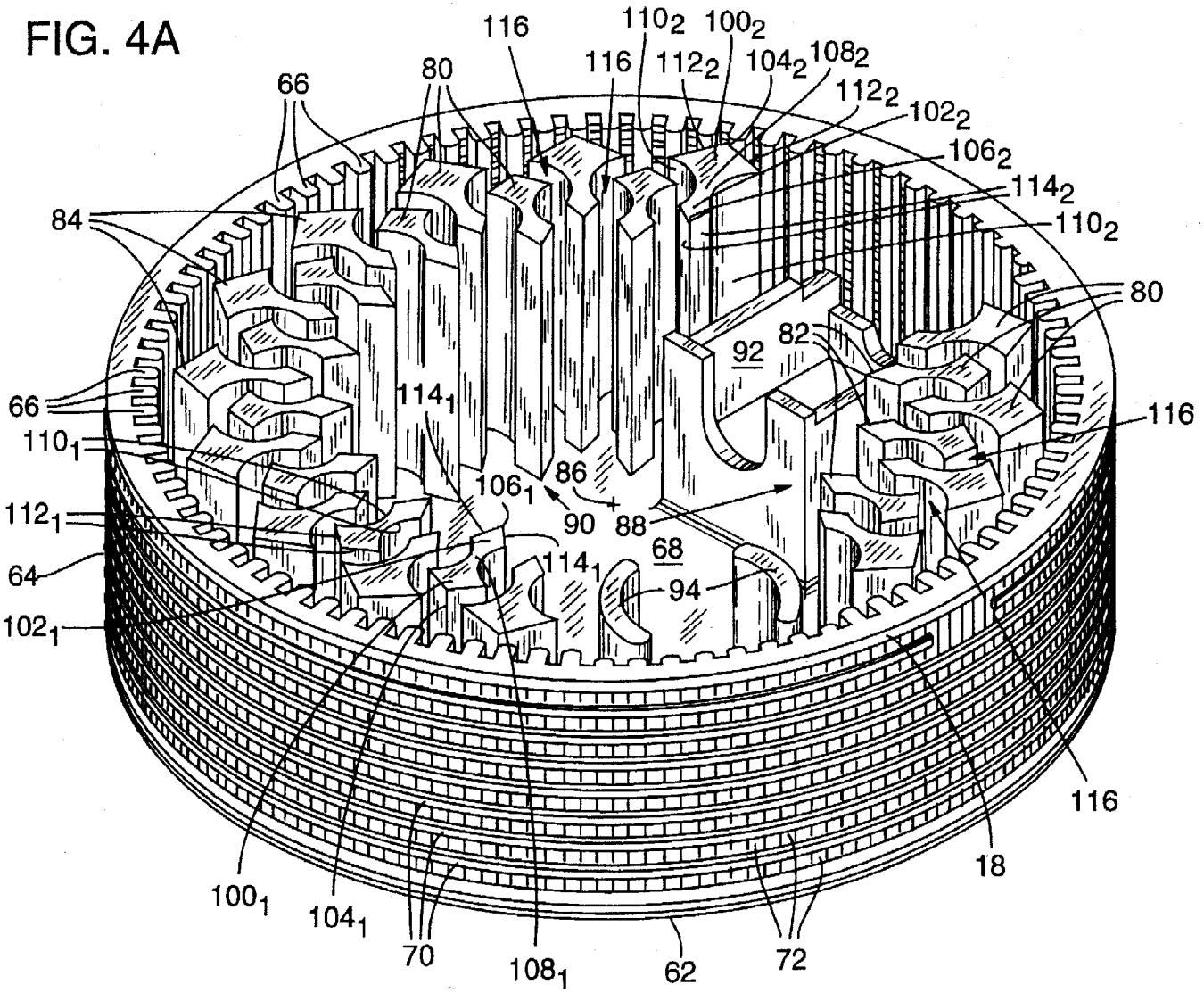
FIGS. 4A and 4B are isometric views taken at different vantage points of the interior of the canopy shown in FIG. 2.
Figure 4B:
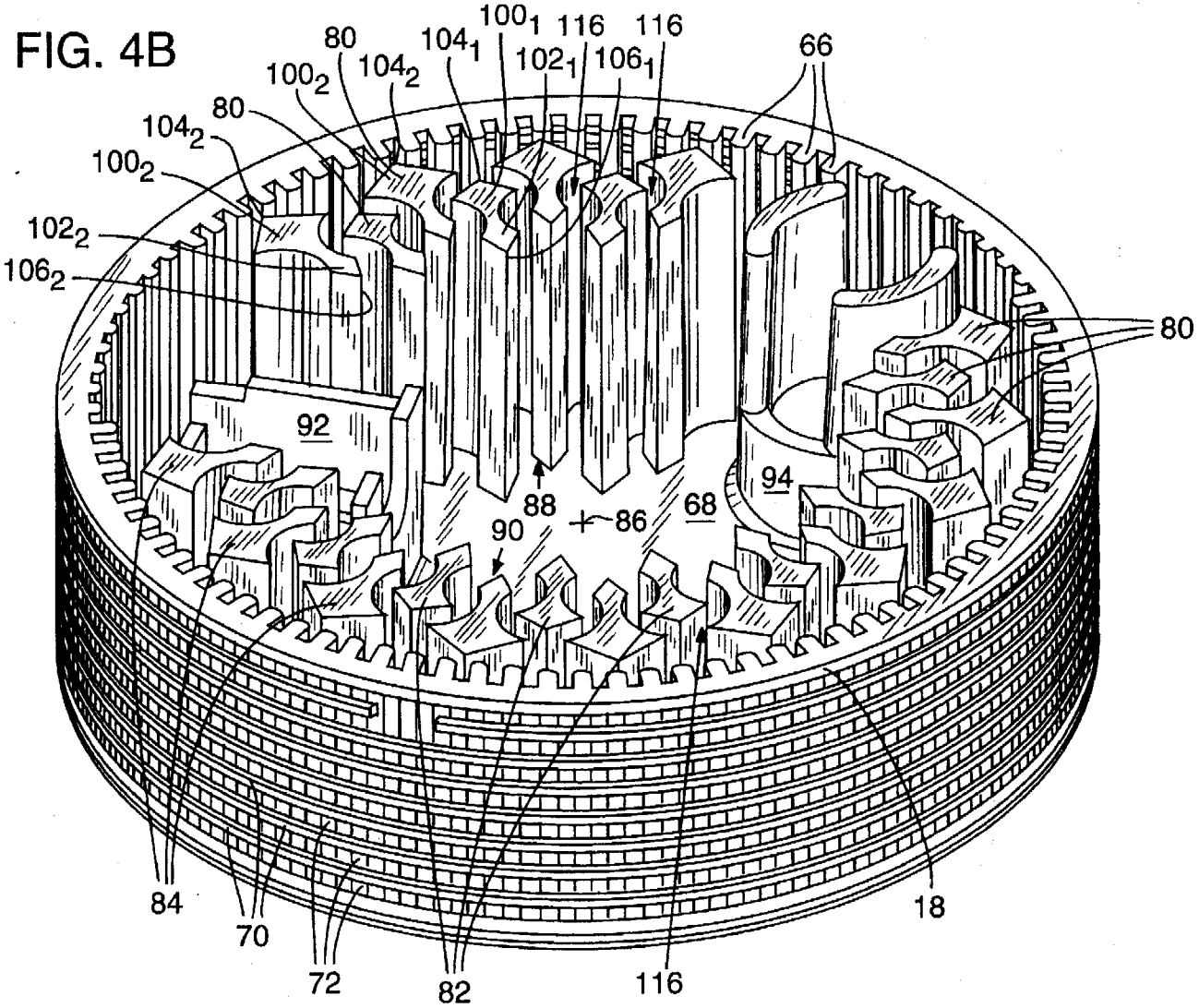
Figure 5:
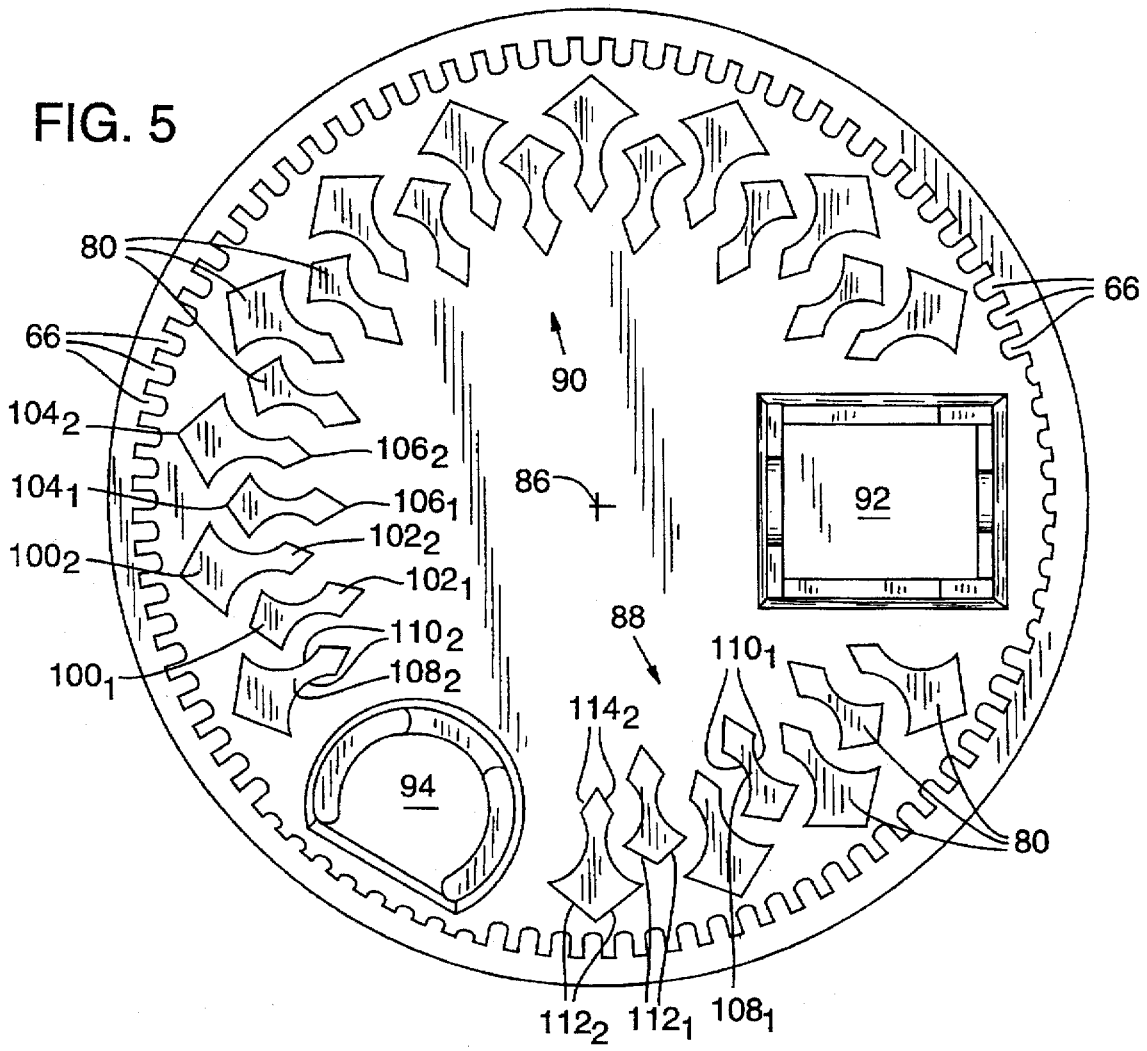
FIG. 5 is a plan view of the interior of the canopy shown in FIG. 2.

With particular reference to FIGS. 4A, 4B, and 5, canopy 14 includes a circular top member 62 from which a porous side member 64 depends to define the periphery and interior of canopy 14 and of the assembled housing 10. The diameter of top member 62 is the same as that of base 12. Side member 64 includes a large number of ribs 66 angularly spaced apart around the periphery of and disposed perpendicularly to the inner surface 68 of top member 62 to define a slitted surface. A set of spaced-apart rings 70 positioned along the lengths of ribs 66 encircle the slitted surface defined by ribs 66 to form a large number of small rectangular apertures 72. The placement of ribs 66 and rings 70 provides side member 64 with a porous surface that serves as a smoke intake filter and a molded-in screen that prevents insects from entering housing 10 and interfering with the operation of LED 24 and photodiode 28.

Apertures 72 are of sufficient size that allows adequate smoke particle intake flow into housing 10. The size of apertures 72 depends upon the angular spacing between adjacent ribs 66 and the number and spacing of rings 70. In a preferred embodiment, a housing 10 having a 5.2 centimeter base and a 1.75 centimeter height has eighty-eight ribs angularly spaced apart by about 4° and nine equidistantly spaced rings 70 to form 0.8 $mm^2$ apertures 72. The ring 70 positioned farthest from top member 62 constitutes snap ring 18.

The interior of canopy 14 contains an array of pegs 80 having multi-faceted surfaces. Pegs 80 are an integral part of canopy 14, being formed during the molding process. Pegs 80 are angularly spaced about the periphery of canopy 14 so that their multi-faceted surfaces can perform several functions. Pegs 80 function as an optical block for external light infiltrating through porous side member 64 of canopy 14, minimize spurious light reflections within the interior of housing 10 toward photodiode 28, and form a labyrinth of passageways for smoke particles to flow freely through the interior of housing 10.

Pegs 80 are preferably arranged in a first group 82 and a second group 84. The pegs 80 of first group 82 are of smaller surface areas and are positioned nearer to center 86 of canopy 14 than are the pegs 80 of second group 84. Thus, adjacent pegs 80 in second group 84 are separated by a recessed peg 80 in first group 82. The pegs 80 of groups 82 and 84 are divided into two sets 88 and 90 that are separated by light shield caps 92 and 94. Caps 92 and 94 mate with the upper surfaces of, respectively, emitter holder 22 of LED 24 and sensor holder 26 of photodiode 28 when housing 10 is assembled. Because of the obtuse angle 34 defined by lines of sight 30 and 32 of LED 24 and photodiode 28, respectively, there are fewer pegs 80 in set 88 than in set 90.

Although the pegs 80 in first group 82 have smaller surface areas than those of the pegs 80 in second group 84, all of pegs 80 are of uniform height measured from top member 62 and have similar profiles. The following description is, therefore, given in general for a peg 80. In the drawings, corresponding features of pegs 80 in first group 82 have the subscript "1" and in the second group 84 have the subscript "2 ".

Each of pegs 80 is of elongated shape and has a larger pointed head section 100 and a smaller pointed tail section 102 whose respective ape lie along the same radial line extending from center 86 of canopy 14. Apex 104 of head section 100 is positioned nearer to side member 64, and apex 106 of tail section 102 is positioned nearer to center 86 of canopy 14. A medial portion 108 includes concave side surfaces 110 that taper toward the midpoint between apex 104 of head section 100 and apex 106 of tail section 102.

Head section 100 includes flat facets or sides 112 joined at apex 104. The surface areas of sides 112 are selected collectively to block normally incident light entering apertures 72 from passing to the interior of housing 10. In one embodiment, each side $112_1$ is 2.0 mm in length, and sides $112_1$ define a 105° angle at apex $104_1$. Each side $112_2$ is 3.2 mm in length, and sides $112_2$ define a 105° angle at apex $104_2$. Medial portions 108 of the proper length block passage of light not blocked by sides 112. Light shield caps 92 and 94 and holders 22 and 26 block the passage of light in the places where pegs 80 are not present in canopy 14.

Tail section 102 includes flat facets or sides 114 joined at apex 106. The surface areas of sides 114 are selected to direct spurious light reflections occurring within housing 10 away from photodiode 28 and toward side member 62 for either absorption or passage outward through apertures 72. In the same embodiment, each side $114_1$ is 1.9 mm in length, and sides $114_1$ define a 60° angle at apex $106_1$. Each side $114_2$ is 1.8 mm in length, and sides $114_2$ define a 75° angle at apex $106_2$. This function of tail sections 102 allows with the use of different canopies 14 the achievement of very uniform, low ambient level reflected radiation signals toward photodiode 28. Canopy 14 can, therefore, be field replaceable and used as a spare part in the event of, for example, breakage, excessive dust build-up over apertures 72 causing reduced smoke infiltration, or excessive dust build-up on pegs 80 causing a higher than nominal clean air voltage.

The amount of angular separation of adjacent pegs 80, the positioning of a peg 80 of first group 82 between adjacent pegs 80 of second group 84, and the length of medial portion 108 of pegs 80 define the shape of a labyrinth of passageways 116 through which smoke particles flow to and from apertures 72. It is desirable to provide passageways 116 having as small angular deviations as possible so as to not impede smoke particle flow.

The smoke particles flowing through housing 10 reflect toward photodiode 28 the light emitted by LED 24. The amount of light sensed by photodiode 28 is processed as follows by the electronic circuitry of the smoke detector system.

Figure 6:
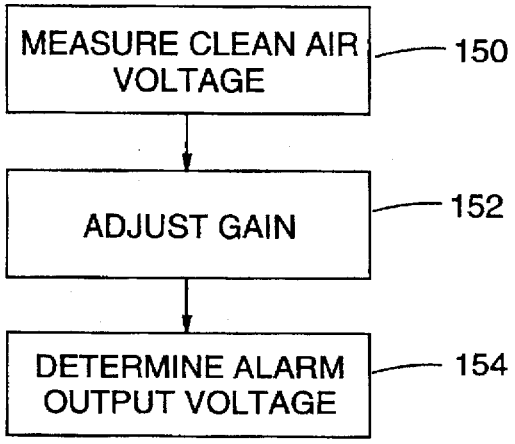
FIG. 6 is a flow diagram showing the steps performed in the factory during calibration of the smoke detector system.

The self-diagnostic capability of the smoke detector system of the invention stems from determining during calibration certain operating parameters of the optical sensor electronics. FIG. 6 is a flow diagram showing the steps performed during calibration in the factory.

With reference to FIG. 6, process block 150 indicates in the absence of a simulated smoke environment the measurement of a clean air voltage that represents a 0 percent smoke obscuration level. In a preferred embodiment, the clean air voltage is 0.6 volt. Upper and lower tolerance threshold limits for the clean air voltage are also set at nominally ±42 percent of the clean air voltage measured at calibration.

Process block 152 indicates the adjustment of the gain of the optical sensor electronics. This is accomplished by placing housing 10 in a chamber filled with an aerosol spray to produce a simulated smoke environment at a calibrated level of smoke obscuration. The simulated smoke particles flow through apertures 72 of canopy 14 and reflect toward photodiode 28 a portion of the light emitted by LED 24. Because the number of simulated smoke particles is constant, photodiode 28 produces a constant output voltage in response to the amount of light reflected. The gain of the optical sensor electronics is adjusted by varying the length of time they sample the output voltage of photodiode 28. In a preferred embodiment, a variable integrating analog-to-digital converter, whose operation is described below with reference to FIGS. 8 and 9, performs the gain adjustment by determining an integration time interval that produces an alarm voltage threshold of approximately 2.0 volts for a smoke obscuration level of 3.1 percent per foot.

Process block 154 indicates the determination of an alarm output voltage of photodiode 28 that produces an alarm signal indicative of the presence of an excessive number of smoke particles in a space where housing 10 has been placed. The alarm voltage of photodiode 28 is fixed and stored in an electrically erasable programmable read-only memory (EEPROM), whose function is described below with reference to FIG. 8.

Upon conclusion of the calibration process, the gain of the optical sensor electronics is set, and the alarm voltage and the clean air voltage and its upper and lower tolerance limit voltages are stored in the EEPROM. There is a linear relationship between the sensor output voltage and the level of obscuration, which relationship can be expressed as $$y=m*x+b,$$

where y represents the sensor output voltage, m represents the gain, and b represents the clean air voltage.

The gain is defined as the sensor output voltage per percent obscuration per foot; therefore, the gain is unaffected by a build-up of dust or other contaminants. This property enables the self-diagnostic capabilities implemented in the present invention.

The build-up of dust or other contaminants causes the ambient clean air voltage to rise above or fall below the nominal clean air voltage stored in the EEPROM. Whenever the clean air voltage measured by photodetector 28 rises, the smoke detector system becomes more sensitive in that it will produce an alarm signal at a smoke obscuration level that is less than the nominal value of 3.1 percent per foot. Conversely, whenever the clean air voltage measured by photodiode 28 falls below the clean air voltage measured at calibration, the smoke detector system will become less sensitive in that it will produce an alarm signal at a smoke obscuration level that is greater than the nominal value.

Figure 7:
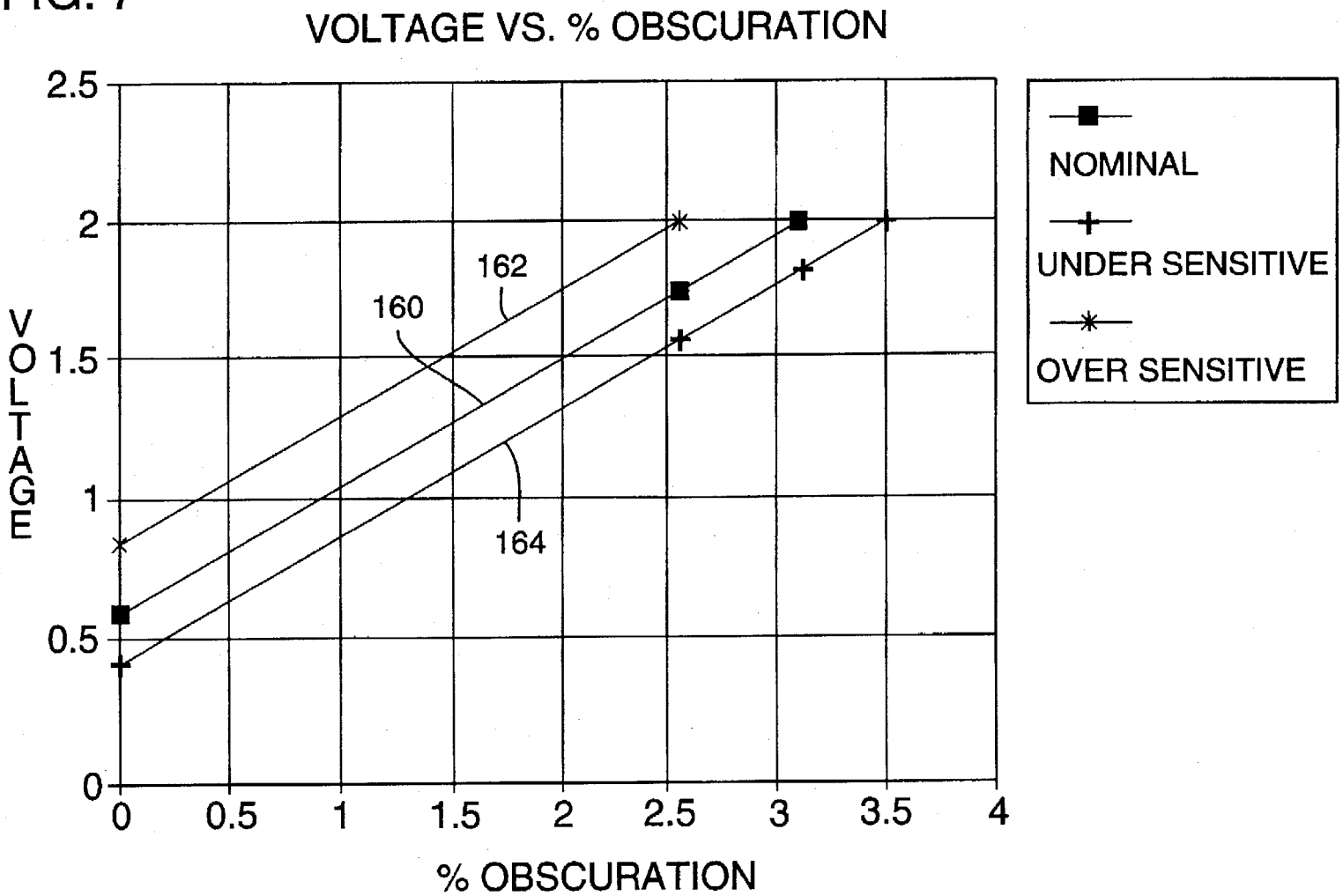
FIG. 7 is a graph of the optical sensor electronics sensitivity, which is expressed as a linear relationship between the level of obscuration and sensor output voltage.

FIG. 7 shows that changes in the clean air voltage measured over time does not affect the gain of the optical sensor electronics. Straight lines 160, 162, and 164 represent, respectively, nominal, over-sensitivity, and under-sensitivity conditions.

There is, therefore, a direct correlation between a change in clean air voltage and a change in sensitivity to an alarm condition. By setting tolerance limits on the amount of change in voltage measured in clean air, the smoke detector system can indicate when it has become under-sensitive or over-sensitive in its measurement of ambient smoke obscuration levels.

To perform self-diagnosis to determine whether an under- or over-sensitivity condition or an alarm condition exists, the smoke detector system periodically samples the ambient smoke levels. To prevent short-term changes in clean air voltage that do not represent out-of-sensitivity indications, the present invention includes a microprocessor-based circuit that is implemented with an algorithm to determine whether the clean air voltage is outside of predetermined tolerance limits for a preferred period of approximately 27 hours. The microprocessor-based circuit and the algorithm implemented in it to perform self-diagnosis is described with reference to FIGS. 8–10.

Figure 8:
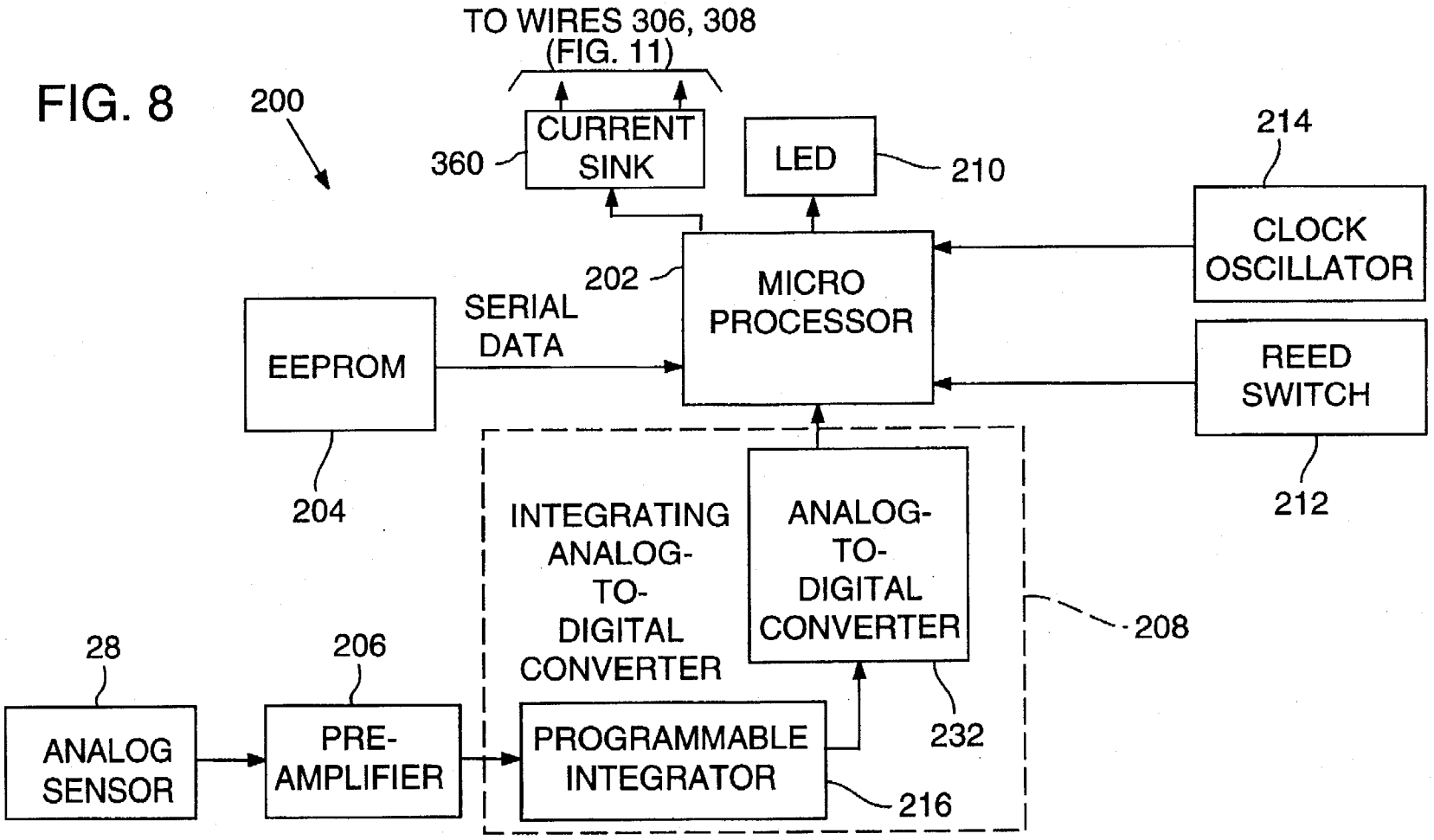
FIG. 8 is a general block diagram of the microprocessor-based circuit that implements the self-diagnostic and calibration functions of the smoke detector system.

FIG. 8 is a general block diagram of a microprocessor-based circuit 200 in which the self-diagnostic functions of the smoke detector system are implemented. The operation of circuit 200 is controlled by a microprocessor 202 that periodically applies electrical power to photodiode 28 to sample the amount of smoke present. Periodic sampling of the output voltage of photodiode 28 reduces electrical power consumption. In a preferred embodiment, the output of photodiode 28 is sampled for 0.4 millisecond every nine seconds. Microprocessor 202 processes the output voltage samples of photodiode 28 in accordance with instructions stored in an EEPROM 204 to determine whether an alarm condition exists or whether the optical electronics are within preassigned operational tolerances.

Each of the output voltage samples of photodiode 28 is delivered through a sensor preamplifier 206 to a variable integrating analog-to-digital converter subcircuit 208. Converter subcircuit 208 takes an output voltage sample and integrates it during an integration time interval set during the gain calibration step discussed with reference to process block 152 of FIG. 6. Upon conclusion of each integration time interval, subcircuit 208 converts to a digital value the analog voltage representative of the photodetector output voltage sample taken.

Microprocessor 202 receives the digital value and compares it to the alarm voltage and sensitivity tolerance limit voltages established and stored in EEPROM 204 during calibration. The processing of the integrator voltages presented by subcircuit 208 is carried out by microprocessor 202 in accordance with an algorithm implemented as instructions stored in EEPROM 204. The processing steps of this algorithm are described below with reference to FIG. 10. Microprocessor 202 causes continuous illumination of a visible light-emitting diode (LED) 210 to indicate an alarm condition and performs a manually operated self-diagnosis test in response to an operator's activation of a reed switch 212. A clock oscillator 214 having a preferred output frequency of 500 kHz provides the timing standard for the overall operation of circuit 200.

Figure 9:
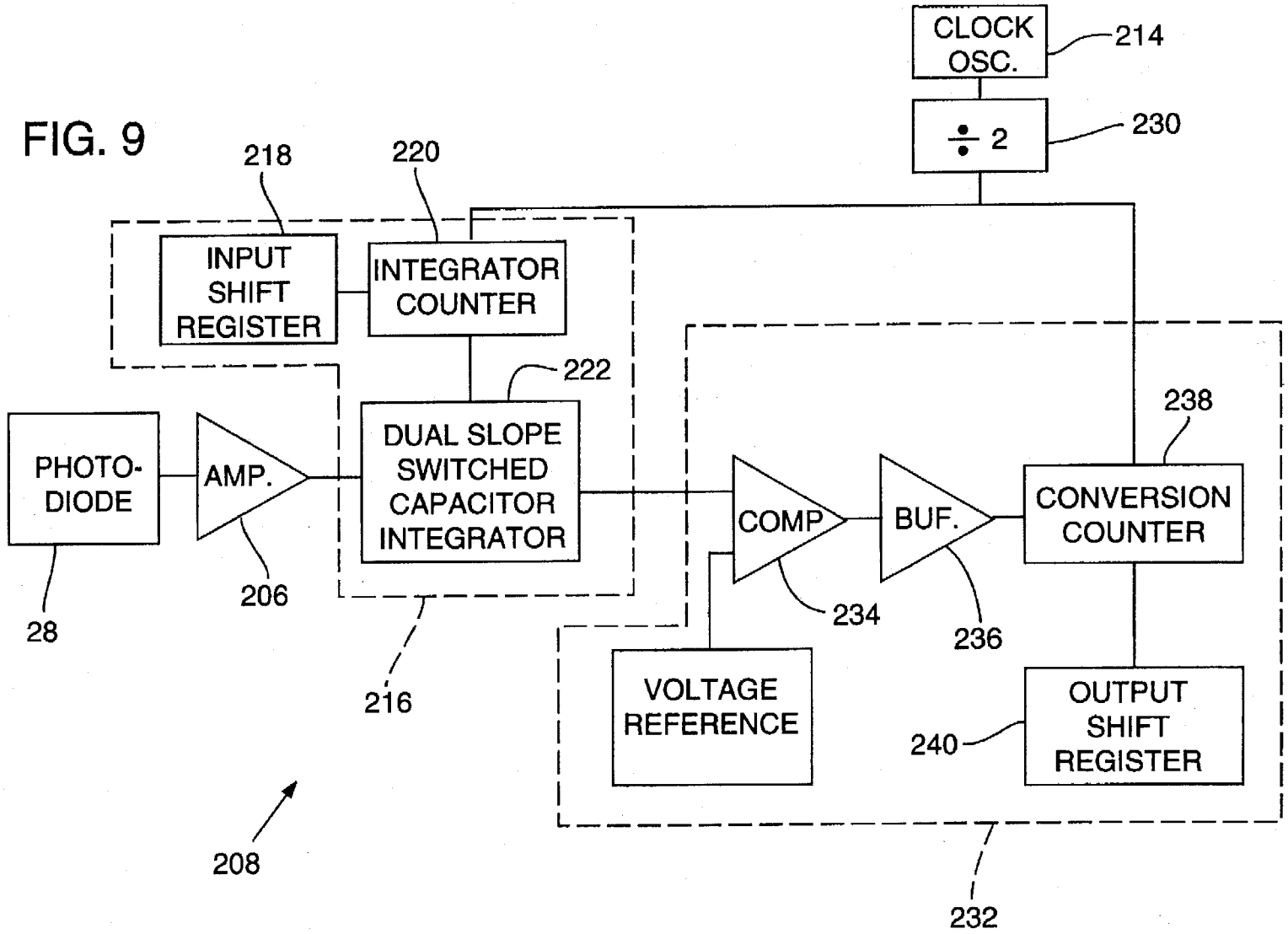
FIG. 9 is a block diagram showing in greater detail the variable integrating analog-to-digital converter shown in FIG. 8.

FIG. 9 shows in greater detail the components of variable integrating analog-to-digital converter subcircuit 208. The following is a description of operation of converter subcircuit 208 with particular focus on the processing it carries out during calibration to determine the integration time interval.

With reference to FIGS. 8 and 9, preamplifier 206 conditions the output voltage samples of photodetector 28 and delivers them to a programmable integrator 216 that includes an input shift register 218, an integrator up-counter 220, and a dual-slope switched capacitor integrator 222. During each 0.4 millisecond sampling period, an input capacitor of integrator 222 accumulates the voltage appearing across the output of preamplifier 206. Integrator 222 then transfers the sample voltage acquired by the input capacitor to an output capacitor.

At the start of each integration time interval, shift register 218 receives under control of microprocessor 202 an 8-bit serial digital word representing the integration time interval. The least significant bit corresponds to 9 millivolts, with 2.3 volts representing the full scale voltage for the 8-bit word. Shift register 218 provides as a preset to integrator up-counter 220 the complement of the integration time interval word. A 250 kHz clock produced at the output of a divide-by-two counter 230 driven by 500 KHz clock oscillator 214 causes integrator up-counter 220 to count up to zero from the complemented integration time interval word. The time during which up-counter 220 counts defines the integration time interval during which integrator 222 accumulates across an output capacitor an analog voltage representative of the photodetector output voltage sample acquired by the input capacitor. The value of the analog voltage stored across the output capacitor is determined by the output voltage of photodiode 28 and the number of counts stored in integrator counter 220.

Upon completion of the integration time interval, integrator up-counter 220 stops counting at zero. An analog-to-digital converter 232 then converts to a digital value the analog voltage stored across the output capacitor of integrator 222. Analog-to-digital converter 232 includes a comparator amplifier 234 that receives at its noninverting input the integrator voltage across the output capacitor and at its inverting input a reference voltage, which in the preferred embodiment is 300 millivolts, a system virtual ground. A comparator buffer amplifier 236 conditions the output of comparator 234 and provides a count enable signal to a conversion up-counter 238, which begins counting up after integrator up-counter 220 stops counting at zero and continues to count up as long as the count enable signal is present.

During analog to digital conversion, integrator 222 discharges the voltage across the output capacitor to a third capacitor while conversion up-counter 238 continues to count. Such counting continues until the integrator voltage across the output capacitor discharges below the +300 millivolt threshold of comparator 234, thereby causing the removal of the count enable signal. The contents of conversion up-counter 238 are then shifted to an output shift register 240, which provides to microprocessor 202 an 8-bit serial digital word representative of the integrator voltage for processing in accordance with the mode of operation of the smoke detector system. Such modes of operation include calibration, in-service self-diagnosis, and self-test.

During calibration, the smoke detector system determines the gain of the optical sensor electronics by substituting trial integration time interval words of different weighted values as presets to integrator up-counter 220 to obtain the integration time interval necessary to produce the desired alarm voltage for a known smoke obscuration level. As indicated by process block 154 of FIG. 6, a preferred desired alarm voltage of about 2.0 volts for a 3.1 percent per foot obscuration level is stored in EEPROM 204. The output of photodiode 28 is a fixed voltage when housing 10 is placed in an aerosol spray chamber that produces the 3.1 percent per foot obscuration level representing the alarm condition.

Because different photodiodes 28 differ somewhat in their output voltages, determining the integration time interval that produces an integrator voltage equal to the alarm voltage sets the gain of the system. Thus, different counting time intervals for integrator up-counter 220 produce different integrator voltages stored in shift register 240.

The process of providing trial integration time intervals to shift register 218 and integrator up-counter 220 during calibration can be accomplished using a microprocessor emulator with the optical sensor electronics placed in the aerosol spray chamber. Gain calibration is complete upon determination of an integration time interval word that produces in shift register 240 an 8-bit digital word corresponding to the alarm voltage. The integration time interval word is stored in EEPROM 204 as the gain factor.

It will be appreciated that the slope of the integration time interval changes during acquisition of output voltage samples for different optical sensors but that the final magnitude of the output voltage of integrator 222 is dependent upon the input voltage and integration time. The slope of the analog-to-digital conversion is, however, always the same. This is the reason why integrator 222 is designated as being of a dual-slope type.

Figure 10:
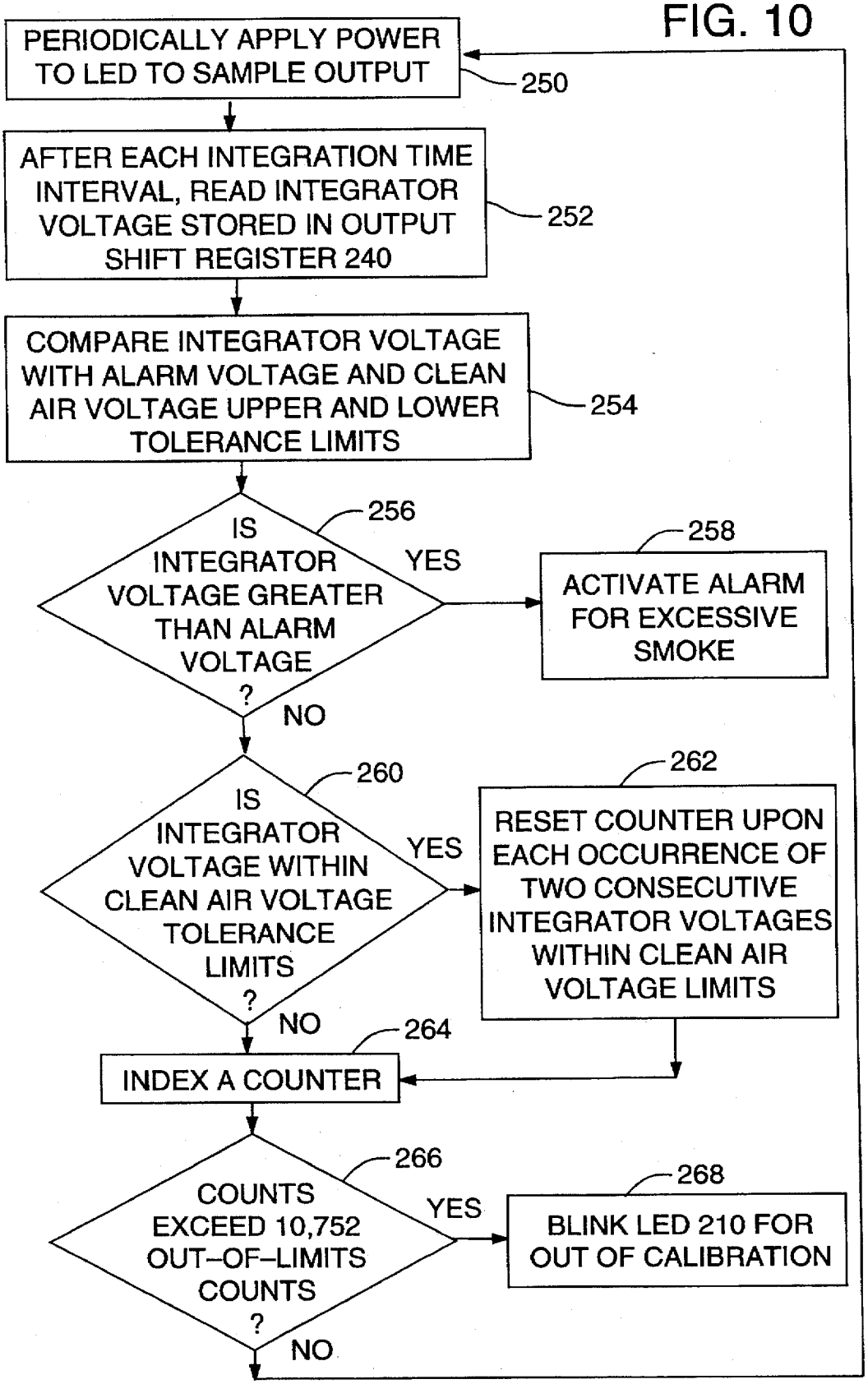
FIG. 10 is a flow diagram showing the self-diagnosis steps carried out by the optical sensor electronics shown in FIG. 8.

FIG. 10 is a flow diagram showing the self-diagnosis processing steps the smoke detector system carries out during in-service operation.

With reference to FIGS. 8–10, process block 250 indicates that during in-service operation, microprocessor 202 causes application of electrical power to LED 24 in intervals of 9 seconds to sample its output voltage over the previously determined integration time interval stored in EEPROM 204. The sampling of every 9 seconds reduces the steady-state electrical power consumed by circuit 100.

Process block 252 indicates that after each integration time interval, microprocessor 202 reads the just acquired integrator voltage stored in output shift register 240. Process block 254 indicates the comparison by microprocessor 202 of the acquired integrator voltage against the alarm voltage and against the upper and lower tolerance limits of the clean air voltage, all of which are preassigned and stored in EEPROM 204. These comparisons are done sequentially by microprocessor 202.

Decision block 256 represents a determination of whether the acquired integrator voltage exceeds the stored alarm voltage. If so, microprocessor 202 provides a continuous signal to an alarm announcing the presence of excessive smoke, as indicated by process block 258. If not so, microprocessor 202 performs the next comparison.

Decision block 260 represents a determination of whether the acquired integrator voltage falls within the stored clean air voltage tolerance limits. If so, the smoke detector system continues to acquire the next output voltage sample of photodiode 28 and, as indicated by process block 262, a counter with a 2-count modulus monitors the occurrence of two consecutive acquired integrator voltages that fall within the clean air voltage tolerance limits. This counter is part of microprocessor 202. If not so, a counter is indexed by one count, as indicated by process block 264. However, each time two consecutive integrator voltages appear, the 2-count modulus counter resets the counter indicated by process block 264.

Decision block 266 represents a determination of whether the number of counts accumulated in the counter of process block 264 exceeds 10,752 counts, which corresponds to consecutive integrator voltage samples in out-of-tolerance limit conditions for each of 9 second intervals over 27 hours. If so, microprocessor 202 provides a low duty-cycle blinking signal to LED 210, as indicated in process block 268. Skilled persons will appreciate that other signaling techniques, such as an audible alarm or a relay output, may be used. The blinking signal indicates that the optical sensor electronics have changed such that the clean air voltage has drifted out of calibration for either under- or over-sensitivity and need to be attended to. If the count in the counter of process block 264 does not exceed 10,752 counts, the smoke detector system continues to acquire the next output voltage sample of photodiode 28.

The self-diagnosis algorithm provides, therefore, a rolling 27-hour out-of-tolerance measurement period that is restarted whenever there are two consecutive appearances of integrator voltages within the clean air voltage tolerance limits. The smoke detector system monitors its own operational status, without a need for manual evaluation of its internal functional status.

Reed switch 212 is directly connected to microprocessor 202 to provide a self-test capability that together with the labyrinth passageway design of pegs 80 in canopy 14 permits on-site verification of an absence of an unserviceable hardware fault. To initiate a self-test, an operator holds a magnet near housing 10 to close reed switch 212. Closing reed switch 212 activates a self-test program stored in EEPROM 204. The self-test program causes microprocessor 202 to apply a voltage to photodiode 28, read the integrator voltage stored in output shift register 240, and compare it to the clean air voltage and its upper and lower tolerance limits in a manner similar to that described with reference to process blocks 250, 252, and 254 of FIG. 10. The self-test program then causes microprocessor 202 to blink LED 210 two or three times, four to seven times, or eight or nine times if the optical sensor electronics are under-sensitive, within the sensitivity tolerance limits, or over-sensitive, respectively. If none of the above conditions is met, LED 210 blinks one time to indicate an unserviceable hardware fault.

To prevent an automatic reset of the 27-hour timer during maintenance, the self-diagnosis algorithm provides an immediate indication of an out-of-calibration condition upon application of electrical power to the smoke detector system. This feature provides a maintenance person calibration status information about the smoke detector system without having to wait an additional 27 hours for the out-of-tolerance measurement period to conclude.

Figure 11:
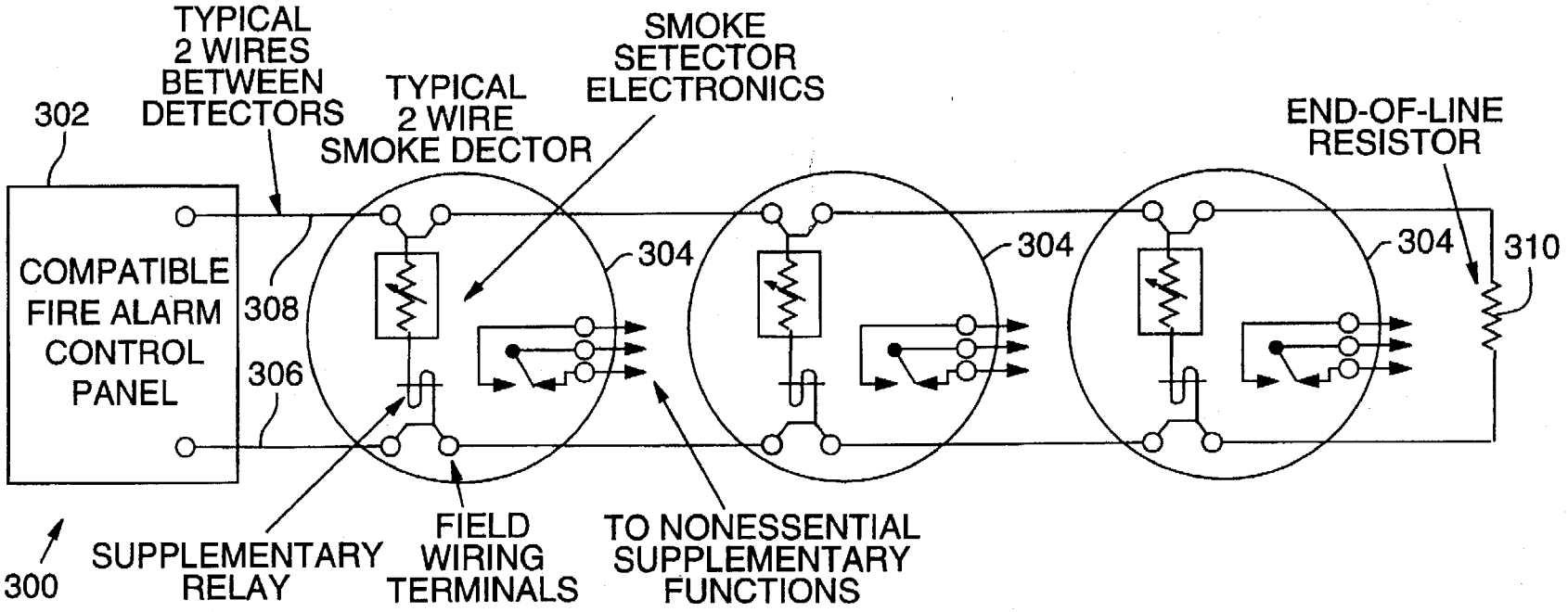
FIG. 11 (Prior Art)
FIG. 11 is a block diagram showing a prior an automatic fire alarm communication system implemented with a conventional two-wire alarm initiating circuit in a central control panel.

Multiple smoke detector systems that each include a microprocessor-based self-diagnostic circuit 200 are sometimes connected to a central station communication system. FIG. 11 is a block diagram showing a prior art automotive fire alarm communication system 300 implemented with a conventional two-wire alarm initiating circuit in a central control panel 302. Each smoke detector system 304 (three shown in FIG. 11) receives electrical power from and transmits an alarm signal on the same two wires 306 and 308 connected to control panel 302. Each smoke detector system 304 indicates the presence of an alarm condition by electronically shunting an end-of-line resistor 310 to increase the amount of electrical current drawn from the alarm initiating circuit in control panel 302. With this arrangement, there is a possibility that control panel 302 will produce a false alarm condition under the following circumstances.

Whenever it is in an alarm condition, a smoke detector system 304 draws on wires 306 and 308 from control panel 302 electrical current in an amount that exceeds an alarm threshold value established in control panel 302. Whenever it is in an out-of-calibration condition, a smoke detector system 304 draws on wires 306 and 308 from control panel 302 electrical current in a below alarm threshold amount that is determined by a sensitivity fault condition signal developed by smoke detector 304 and representative of an out-of-calibration condition. A typical alarm threshold established in control panel 302 would be 12.0–16.0 milliamperes sustained for a ±0.3 seconds delay.

A potential problem arises whenever multiple smoke detector systems 304 concurrently develop sensitivity fault condition signals that superimpose to exceed the alarm threshold value and thereby cause a false alarm condition. Such an event could occur when electrical power delivery to communication system 300 has been interrupted to disable all of smoke detector systems 304 and then has been later restored to simultaneously re-energize all of smoke detector systems 304. This event happens during the self-test procedure described above. If several of smoke detector systems 304 were in out-of-calibration conditions at the time of power interruption, the restoration of power would concurrently re-establish each of their sensitivity fault condition signals that could superimpose to exceed the alarm threshold value.

Figure 12:
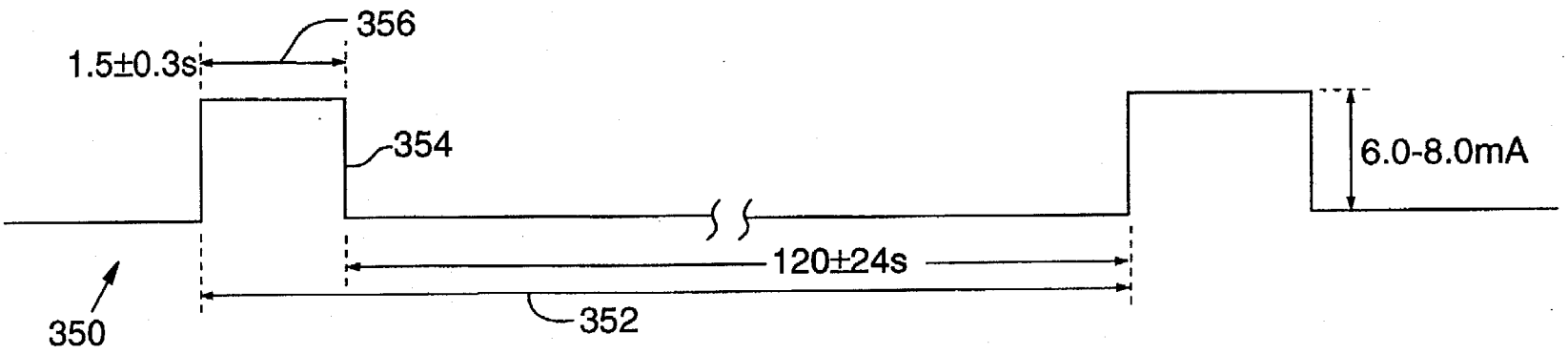
FIG. 12 (Prior Art)
FIG. 12 shows a prior an sensitivity fault conditional signal waveform.

FIG. 12 shows a prior an sensitivity fault condition signal waveform 350 that is susceptible to causing this false alarm condition. This signal waveform is implemented in the Model 700 Series smoke detectors manufactured by Sentrol, Inc., the assignee of this application. Waveform 350 includes in a repetitive sequence 352 one positive-going pulse 354 of predetermined duration 356. Each pulse 354 in sequence 352 draws from the control panel about 6.0–8.0 milliamperes for an alarm threshold time window of about 1.5±0.3 seconds. Pulse sequence 352 repeats itself about every 120±24 seconds. Because prior art control panels require the presence of above-threshold electrical current for about 1.5±0.3 seconds before issuing an alarm, only two out-of-calibration smoke detector systems associated with communication system 300 would cause an alarm condition. Thus, there is a high probability that prior art pulse sequence 352 would cause a false alarm.

FIG. 8 shows that microprocessor 202 of self-diagnostic circuit 200 of the preferred self-diagnostic smoke detector system provides to a current sink circuit 360 the sensitivity fault condition signal, which is representative of out-of-calibration conditions requiring canopy replacement or cleaning to restore nominal operation. Current sink circuit 360 makes the sensitivity fault condition signal compatible for delivery to wires 306 and 308 of communication system 300 to which the smoke detector system of the present invention can be operatively connected.

Figure 13:
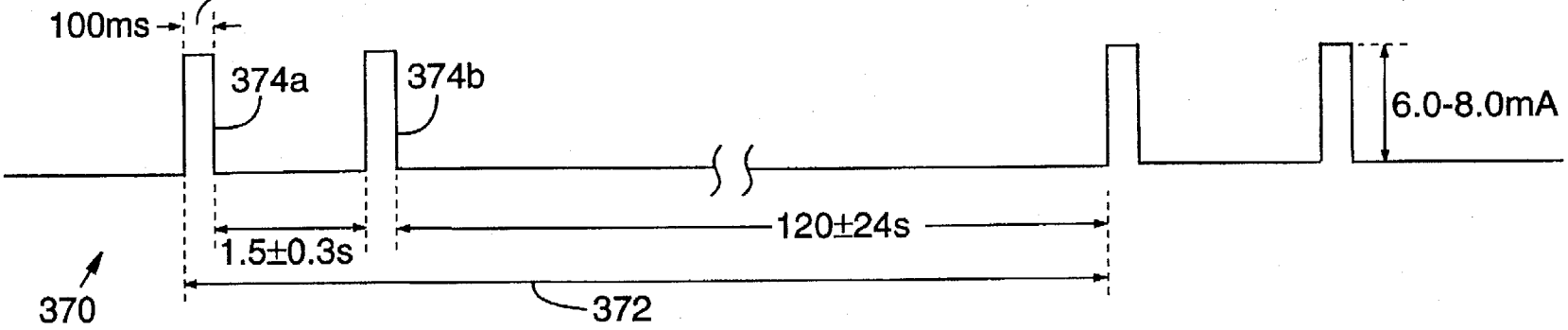
FIG. 13 shows a false alarm immune sensitivity fault condition signal waveform of the present invention.

FIG. 13 shows a false alarm immune sensitivity fault condition signal waveform 370 of the present invention that includes in a repetitive sequence 372 two time-displaced positive-going pulses **374*a* and 374*b* each of which of a duration 376 that is substantially less than duration 356 of pulse 354 in prior art sequence 352. Waveform 370 is generated by microprocessor 202 of self-diagnostic circuit 200. Each of pulses 374*a* and 374*b* in sequence 372 draws from the control panel about 6.0 –8.0 milliamperes for about 100 milliseconds, and pulses 374*a* and 374*b* are displaced in time by about 1.5±0.3 seconds (measured from the negative-going edge of pulse 374*a* to the positive-going edge of pulse 374*b*). Pulse sequence 372 repeats itself about every 120±24 seconds. Two pulses 374*a* and 374*b* are provided in sequence 372** for noise immunity purposes to distinguish an episodic noise spike of similar pulse magnitude and duration from a fault condition signal pulse.

Pulse sequence 372 reduces the probability of a false alarm for the following reason. Although only two smoke detector systems concurrently producing fault condition signal waveforms 370 would exceed the 12.0–16.0 milliampere alarm threshold set in control panel 302, about 30 smoke detector systems concurrently producing fault condition signals 370 would be required to produce 12.0–16.0 milliamperes avenge current for the required 1.5±0.3 seconds delay. Skilled persons will appreciate that different inherent delay paths cause timing offsets among different signal waveforms 370 even though they are initiated at the same time. Accordingly, a false alarm condition could be created by the occurrence of thirty fault condition signal waveforms 370 during the 1.5±0.3 seconds alarm threshold time window. The term "concurrent" as used in this application is, therefore, not restricted to the precise coincidence of multiple fault condition signal waveforms 370. Because no more than 30 smoke detector systems are typically associated with any one communication system 300, the probability of a false alarm condition stemming from concurrent fault condition signal waveforms 370 is greatly diminished.

It will be obvious to those having skill in the art that many changes may be made to the details of the above-described preferred embodiment of the present invention without departing from the underlying principles thereof. For example, the system may use other than an LED a radiation source such as an ion particle or other source. The scope of the present invention should, therefore, be determined only by the following claims.

We claim:

1. In an automatic fire alarm communication system implemented with a conventional two-wire alarm initiating circuit that develops an alarm indication in response to an alarm signal pulse of predetermined minimum duration and predetermined magnitude, a self-diagnostic smoke detector system comprising:

a signal sampler cooperating with a radiation sensor to produce signal samples indicative of periodic measurements of a smoke obscuration level in a spatial region;

a processor receiving and processing the signal samples, the processor comparing the signal samples to multiple threshold values, one of the threshold values representing a smoke obscuration alarm level and another of the threshold values representing a tolerance limit for the radiation sensor, and the processor determining from the signal samples corresponding to smoke obscuration levels that exceed the alarm level and from signal samples corresponding to smoke obscuration levels that exceed the tolerance limit whether the signal samples are indicative of an alarm condition or an out-of-calibration condition of the system; and a signal generator that develops and provides to the communication system a sensitivity fault condition signal comprising a repetitive multiple-pulse sequence in response to a determination by the processor that the signal samples indicate an out-of-calibration condition, the sensitivity fault condition signal including in each sequence multiple time-displaced pulses each of which having a duration that is substantially less than the predetermined minimum duration so as to diminish the probability of approximately concurrent sensitivity fault condition signals produced by multiple smoke detector systems causing the alarm initiating circuit to generate a false alarm signal.

2. The system of claim 1 in which the radiation sensor provides a sensor signal and in which the signal sampler includes an electrically variable gain controller that integrates a sample of the sensor over an integration time interval to produce a corresponding signal sample for comparison to the threshold values.

3. The system of claim 2 in which the radiation sensor and the gain controller are characterized by an adjustable gain factor, the gain factor being adjustable by adjusting the integration time interval.

4. The system of claim 1 in which the radiation sensor produces a sensor signal corresponding to a clean air smoke obscuration level to which the tolerance limit is related.

5. The system of claim 1 in which the radiation sensor produces a signal corresponding to a clean air smoke obscuration level and in which the multiple threshold values include two tolerance limits, the two tolerance limits having values above and below the clean air smoke obscuration level to indicate over- and under-sensitive conditions of the system.

6. The system of claim 1 in which the processor is of a microprocessor-based type.

7. The system of claim 1, further comprising self-test circuitry that verifies the reliability of the operation of the signal sampler and the processor in determining the presence of an alarm condition or an out-of-calibration condition.

8. The system of claim 1 in which each of the multiple time-displaced pulses has a magnitude that is substantially less than the predetermined magnitude.

9. The system of claim 1 in which the sensitivity fault condition signal includes only two time-displaced pulses in the sequence.

* * * * *